US010640722B2

(12) United States Patent
Eisner et al.

(10) Patent No.: US 10,640,722 B2
(45) Date of Patent: May 5, 2020

(54) LUBRICATING MIXTURE HAVING GLYCERIDES

(71) Applicant: FRAUNHOFER-GESELLSCHAFT ZUR FOERDERUNG DER ANGEWANDTEN FORSCHUNG E.V., Munich (DE)

(72) Inventors: Peter Eisner, Freising (DE); Thomas Herfellner, Freising (DE); Andreas Staebler, Kirchheim (DE); Andreas Malberg, Munich (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 15/755,250

(22) PCT Filed: Aug. 16, 2016

(86) PCT No.: PCT/EP2016/069395

§ 371 (c)(1),
(2) Date: Feb. 26, 2018

(87) PCT Pub. No.: WO2017/036785

PCT Pub. Date: Mar. 9, 2017

(65) Prior Publication Data

US 2018/0245009 A1 Aug. 30, 2018

(30) Foreign Application Priority Data

Aug. 31, 2015 (DE) ..... 10 2015 011 148

(51) Int. Cl.
*C10M 105/32* (2006.01)

(52) U.S. Cl.
CPC .... *C10M 105/32* (2013.01); *C10M 2207/281* (2013.01); *C10M 2207/289* (2013.01); *C10M 2207/2815* (2013.01); *C10M 2207/2895* (2013.01); *C10M 2207/401* (2013.01); *C10N 2230/06* (2013.01); *C10N 2240/04* (2013.01); *C10N 2240/10* (2013.01)

(58) Field of Classification Search
CPC ..... C10N 2240/10; C10N 2240/04; C10M 2207/401; C10M 2207/2895
USPC ..... 508/486
See application file for complete search history.

(56) References Cited

U.S. PATENT DOCUMENTS

| | | | | |
|---|---|---|---|---|
| 4,783,274 | A | 11/1988 | Jokinen et al. | 252/32.7 |
| 2003/0040444 | A1* | 2/2003 | Garmier | C10M 169/044 508/491 |
| 2005/0112267 | A1 | 5/2005 | Kian et al. | 426/602 |
| 2008/0153143 | A1* | 6/2008 | Schorken | C10L 1/026 435/134 |
| 2011/0039742 | A1 | 2/2011 | Bloom | 508/496 |
| 2011/0195885 | A1 | 8/2011 | Botz | 508/506 |
| 2011/0289828 | A1* | 12/2011 | Eisner | C10L 1/02 44/308 |

FOREIGN PATENT DOCUMENTS

| | | | | |
|---|---|---|---|---|
| DE | 10 2010 009 030 | A1 | 8/2001 | F16H 57/04 |
| DE | 203 05 164 | U1 | 9/2004 | C10M 105/34 |
| DE | 600 31 505 | T2 | 8/2007 | C11C 3/10 |
| DE | 10 2010 009 030 | A1 | 8/2011 | F16H 57/04 |
| DE | 20 2009 018 507 | U1 | 1/2012 | C10M 173/02 |
| WO | WO 2006/077023 | A2 | 7/2006 | C11C 3/00 |
| WO | WO 2007/082299 | A2 | 7/2007 | C10M 125/22 |
| WO | WO 2009/021486 | A1 | 2/2009 | C10L 1/18 |
| WO | WO 2010/043371 | A1 | 4/2010 | C10M 101/04 |
| WO | WO 2010/118891 | A1 | 10/2010 | C10M 169/04 |

OTHER PUBLICATIONS

International Search Report dated Nov. 2, 2016 in related application No. PCT/EP2016/069395.
Written Opinion dated Nov. 2, 2016 in related application No. PCT/EP2016/069395.

* cited by examiner

*Primary Examiner* — Vishal V Vasisth
(74) *Attorney, Agent, or Firm* — Renner Kenner Greive Bobak Taylor & Weber

(57) ABSTRACT

The present invention relates to a lubricating mixture, which contains glycerides of natural origin and fatty acid alkyl esters. The glycerides are at least partly mono and/or diglycerides which form a mass fraction of 10% in the mixture. In a temperature range from ≥10° C. to at least 15° C. the mixture has a liquid phase with a solid fraction of 1 vol. %, which is formed from a fraction of glycerides and/or fatty acid alkyl esters. The mixture can be formed entirely from renewable raw materials, has a high viscosity index and is particularly suitable as a lubricant for use in gearings, electric motors or internal combustion engines.

26 Claims, No Drawings

LUBRICATING MIXTURE HAVING GLYCERIDES

CROSS-REFERENCE TO RELATED APPLICATION

This is a § 371 application of International patent application number PCT/EP2016/069395 filed Aug. 16, 2016, which claims the benefit of German patent application number 10 2015 011 148.5, filed Aug. 31, 2015, and which are incorporated herein by reference.

TECHNICAL FIELD OF APPLICATION

The invention relates to a lubricating mixture which contains at least a mass fraction of ≥50% of glycerides of natural origin and a fraction of fatty acid alkyl esters and which is particularly suitable for use in gearings, electric motors or internal combustion engines.

PRIOR ART

Lubricating liquids comprising mineral oils, synthetic oils, vegetable oils or water to which additives are usually added to improve the lubricating properties are known from industrial application. The task of the liquids consists in producing a liquid film on the surface of components to thereby reduce friction losses between components moving towards one another and to minimize wear. In addition to established raw materials such as, for example, oil, natural raw materials are increasingly being used which in many cases can be modified (e.g. cellulose in DE202009018507U1) and/or activated before being used as lubricant. Very high requirements are particularly imposed on gear or engine oils in the lubrication area since these should be chemically stable over a long time and in many cases are exposed to high temperature fluctuations which can have an effect on the lubricating properties. In many cases, these high requirements cannot be satisfied either by synthetic nor by natural greases and oils.

The so-called viscosity index which describes the temperature dependence of the kinematic viscosity of a lubricating oil was defined to assess the temperature dependence of lubricants. Oils having a low viscosity index show a stronger temperature-dependent viscosity variation than those having a high viscosity index. The latter are particularly desired in lubricant applications.

The disadvantages of the increased viscosity at low temperatures is discussed in detail for example in DE 102010009030A1. According to this, in many cases gear oils at low ambient temperature compared to the operating temperature have a significantly increased viscosity which only decreases slowly after starting up the motor vehicle due to the frictional heat produced in the gearing, which results in power losses. In order to avoid this disadvantages DE 102010009030A1 describes a method in which the gearing of a motor vehicle is preheated in order to keep the viscosity of the lubricant largely constant during application. However, this solution approach is associated with high costs.

In technical applications in gearings or motors, oil-based hydrocarbons are usually used as base medium, which can damage the environment and whose use is associated with health risks. Vegetable oils are an environmentally friendly alternative to oil-based products and are based on renewable natural resources. The use of vegetable oils as lubricant is however subject to limits due to the property of some oils to solidify at low temperatures, as a result of a low viscosity index and on account of the frequently lacking oxidative stability.

In order to improve the viscosity properties, EP2350240A1 describes the use of vegetable oil with a high fraction of unsaturated fatty acids as gear oil or hydraulic liquid, wherein the oil has a natural viscosity index (VI) of greater than or equal to 200 and a fraction of monounsaturated fatty acids of greater than 80%, a fraction of double unsaturated fatty acids of a maximum of 1-10% and a fraction of triple unsaturated fatty acid of less than 1%. In this case, a portion of the vegetable oil can be used in the form of an unsaturated ester of the vegetable oil. In the description it is pointed out that gear oils or hydraulic oils should be thin-liquid at low temperatures (<40° C.) in order to be better pumpable, which is achieved by using vegetable oil such as rape-seed or sunflower oil with a high fraction of unsaturated fatty acids. The appearance of a solid phase in the lubricating medium should absolutely be avoided according to the description.

Industrial oils should also have a high oxidative stability which is generally related to the unsaturated fatty acids present in vegetable fatty acid alkyl chains. The reaction of a vegetable oil with oxygen can result in polymerization and cross-linking of the fatty acid alkyl chains and reduced oxidative stability. Oils based on saturated hydrocarbons have none or only small fractions of unsaturated fatty acids and therefore have a high oxidative stability. DE60031505T2 describes a method for increasing the oxidative stability and for improving the lubricating properties of a vegetable oil. In this case, the vegetable oil is transesterified with a short-chain fatty acid ester and volatile components are separated after the transesterification. The vegetable oil can have a content of monounsaturated fatty acids of at least 50% and for example be selected from the group consisting of maize oil, rape-seed oil, soya oil and sunflower oil. The short-chain fatty acid ester can be saturated and is four to 10 carbon atoms long. This type of transesterification with different synthetic components is an expensive process and is therefore associated with economic disadvantages.

Mineral-oil based hydraulic oils are known. These usually have a viscosity index of about 100. Additives are added to the mineral oil to ensure corrosion protection and increase its ageing resistance. In addition, viscosity index improvers are added. These are to be understood as long-chain synthetic hydrocarbon compounds which are present homogeneously distributed in cold oils and only have a slight viscosity-increasing effect but unfold at higher operating temperatures and increase their volume dissolved in the oil. The oil thickens as a result and the viscosity index increases. However, these viscosity index improvers have the disadvantage that the long-chain hydrocarbon compounds are cleaved into smaller fragments under loading, with the result that their original thickening effect partially changes significantly. This effect is also known as permanent loss of shear.

U.S. Pat. No. 4,783,274A describes a hydraulic medium which is based on triglycerides of fatty acids. The triglycerides used in this lubricating medium must have an iodine number between and 100. This comprises non-drying and semi-drying triglycerides such as peanut, olive, sunflower, maize and rape-seed oil. These oils have a cloud point of about 5° C., in the case of olive oil even of −5° C. The vegetable-oil-based lubricating medium described in U.S. Pat. No. 4,783,274A therefore has no solid fraction at temperatures greater than 10° C.

DE20305164U1 describes a lubricant based on fatty acid esters. For this purpose vegetable or animal fats are transesterified with monovalent alcohols having a chain length between three and six C atoms. During this transesterification process, glycerine is produced as a side product and is separated since it is insoluble in the fatty acid alkyl esters: The lubricant described in DE20305164U1 therefore contains no glycerides.

US2003040444A1 describes a biodegradable penetrating oil with anticorrosive properties. The lubricant consists of natural and synthetic triglycerides, an organic solvent and an antioxidant. Lactic acid alkyl esters (ethyl lactate), mineral oils as well as mixtures of both are proposed as solvent. In order to improve the penetrating property of the lubricant, fatty acid methyl esters of soya oil can optionally be added. The use of partial glycerides is not described. Since this lubricant is explicitly a penetrating oil, i.e. a medium having low viscosity and good penetrating behaviour, a solid fraction is undesirable.

US2005112267A1 describes a lubricant consisting of palm oil and palm oil side products. The base fluid for this lubricating medium is palmolein, a liquid partial fraction of palm oil. According to this document, the iodine number of the palmolein used must be at least 56 in order to avoid the formation of fat crystals. Other lubricant components are tocopherols of palm oil and fatty acid alkyl esters. The latter are synthesized from free fatty acids and hindered polyvalent alcohols. Neopentyl glycol, trimethylol propane, pentaerythritol and dipentylerythritol are used as hindered alcohols. The esters produced are therefore not mono- and diglycerides. As a result of the use of palmolein, the lubricant has no solid fraction.

US2011039742A1 describes a lubricant additive obtained from vegetable oil. Unsaturated vegetal oils are cross-linked by the action of heat to produce this. A subsequent transesterification of the non-polymerized oils allows these to be separated. The described additive thus consists of polytriglycerides linked via covalent bonds.

WO 2010/118891 A1 describes a lubricating liquid and method for producing this. This is a mixture of mono-, di- and triacyl glycerides, free fatty acids and fatty acid alkyl esters. This lubricant is explicitly a liquid. A solid fraction is not described.

The object of the present invention consists in providing a lubricating medium with high viscosity index, which can be advantageously used in gearings, motors or other units to be lubricated, which can be produced cost-effectively and can also consist entirely of renewable raw materials and therefore does not present a high potential risk when it enters into the environment.

DESCRIPTION OF THE INVENTION

The object is solved by the lubricating mixture according to patent claim 1. Advantageous configurations of the mixture are the subject matter of the dependent patent claims or can be deduced from the following description and the exemplary embodiments.

The proposed mixture contains at least a mass fraction of ≥50% of glycerides of natural origin and a fraction of fatty acid alkyl esters with 1 to 4 C atoms in the alkyl group. The mixture is characterized in that the glycerides are at least partly mono- and/or diglycerides, which form a mass fraction of ≥10% in the mixture and that in a temperature range from >10° C. to at least 15° C., preferably to at least 20° C., the mixture has a liquid phase with a solid fraction of ≥1 vol. % which is formed from a fraction of the glycerides and/or the fatty acid alkyl esters.

The occurrence of the solid phase (solid fraction) is characterized in that the light transmission of the mixture is 10% to 90% lower than that of a completely liquid reference of the same composition at correspondingly higher temperature. The solid fraction is in this case preferably selected so that the light transmission is 10% to 50%, ideally 10% to 20% lower than that of the reference. Methods for determining the light transmission are for example photometers or measuring devices which operate according to the TURBISCAN® principle.

The lubricating mixture according to the invention, hereinafter also designated as lubricant, therefore satisfies the lubricating effect of two systems at once, in which the properties of lubricating oils (liquid phase) and lubricating greases (solid phase) are combined. In order to develop the function, it is advantageous if the mixture has a predominantly liquid consistency, i.e. the volume fraction of liquid in the mixture is >40%, advantageously >80%, particularly advantageously >90%. The mixture can also be formed or produced entirely from renewable raw materials, in particular vegetable oils and fats.

Surprisingly the fraction of solids does not adversely affect or only insignificantly adversely affects the properties of the lubricant but results in an improved chemical resistance of the lubricant compared to the use of pure vegetable oils. The lubricant can therefore easily be used in industrial lubricating applications.

The size of the solid particles which form the solid fraction of the proposed mixture can be very different according to the invention and can range from clumps of solid having an edge length of several centimetres to small particles having an edge length of less than 1 mm, preferably less than 100 μm, in some cases less than 1 μm. In particular, particles between 4 μm and 5 mm show a good lubricating effect since they penetrate for example in gearings into the space between the gear wheels and can develop an advantageously lubricating effect there. This quite considerably reduces the wear between the metal surfaces compared to other non-lubricating solid particles in the lubricant and prevents abrasive components from penetrating between the gear wheels or into gaps and there developing their abrasive effect.

The lubricant according to the invention consists of predominant fractions of tri- and partial glycerides of natural oils and fats as well as fatty acid alkyl esters with 1 to 4 C atoms in the alkyl group. Particularly advantageous properties are obtained if the mass fraction of triglycerides in the lubricant is >30%, preferably >40%, ideally >50%. In a particularly advantageous embodiment of the invention, the mass fraction of fatty acid alkyl esters is >10%, ideally >15%. Particularly advantageous properties are obtained if the fraction of diglycerides is >10%, ideally >15%, and the fraction of monoglycerides is >5%.

In one embodiment of the invention, the lubricant contains a fraction of unbound mono- or polyvalent alcohol. Preferably this fraction lies between 0.1 and 4%, ideally between 0.1 and 2%.

The solid fraction will advantageously consist of components contained in the natural raw material (fat, oil) from which the glycerides are obtained for the mixture or which are obtained from this raw material. In a particularly advantageous embodiment of the invention, in addition to the aforesaid solids based on fats and/oils or fatty acid esters, the lubricant also contains other organic or inorganic components which do not originate from the natural raw material and which are still solid even at high temperatures of at least 90° C. These particles preferably have a diameter of 0.1 to 1.5 μm, ideally 0.2 to 1 μm and surprisingly improve the run-in properties of gearings. The fraction of this solid fraction in the lubricant is preferably between 0.1 and 3%, ideally between 0.15 and 2%. Examples for such foreign particles are metals and metal compounds having a non-oxidative action such as iron or aluminium oxides, inert compounds based on silicon such as silicon oxide as well as synthetic and natural polymers such as polystyrene, polyethylene, polyethylene terephthalate, polypropylene, polycarbonate, polyhydroxy alkanoate, polylactic acid, proteins, starches, celluloses as well as other derivatives.

In an advantageous embodiment of the invention, the composition of the solid particles from the glycerides differs from the composition of the liquid phase. Thus, the monoglyceride fraction in the solid phase is ideally a factor of >1.5, advantageously a factor of >2, particularly advantageously a factor of >5 higher than in the liquid phase.

Various methods can be used to produce the proposed mixture, wherein fats containing a high fraction of saturated fatty acids are advantageously used as raw material at least in part. These can be vegetable fats such as palm oil, palm kernel oil or coconut oil or other fats which contain a high fraction of saturated fatty acids of >30 mass %, particularly advantageously >80 mass %, and which are still solid at a temperature of 20° C. By conversion of a part of the triglycerides of these fats into mono- and/or diglycerides, a very oxidation-stable lubricant is obtained so that at a temperature of 20° C., a large proportion is liquid so that pumping is possible and a surprisingly high lubricating effect is achieved. This is not achieved with an untreated vegetable fat.

The use of unrefined or only partially refined vegetable oils and fats as raw material is particularly advantageous. The lubricant obtained therefrom has a particularly good oxidation stability.

Furthermore the lubricant has particularly advantageous properties when only the hydratizable phospholipids are removed in the refining process or when fatty components which are usually separated in the vegetable oil refining are not removed or are added again. Examples for such compounds are carotinoids, non-hydratizable lecithins, phenols and phenolic acids, tocopherols, phorbol ester etc.

Surprisingly the mixture of triglycerides and partial glycerides and fatty acid esters according to the invention has a higher viscosity index of >200 compared to the untreated oils and fats.

Particularly advantageous are mixtures in which a portion of the glycerides is present as a solid phase at temperatures of at least 20° C.

For further improvement of the viscosity index of the mixtures it is advantageous to use, in addition to the fat components which are still solid at a temperature of 20°, components of vegetable oils which are liquid at this temperature and contain long-chain unsaturated fatty acids. This can be achieved by adding oils which contain a high content of unsaturated fatty acids such as, for example, rape-seed or sunflower oil, wherein the fraction of these oils should be selected to be less than 50 mass %, advantageously less than 10 mass % to obtain oxidation stability. In this case it is both possible to add low-viscosity oil before the conversion of the triglycerides or after the conversion.

In a particularly simple embodiment of the invention, in order to obtain the advantageous properties it can be sufficient to produce a mixture of fats and oils which is pumpable at room temperature. An astonishingly good lubricating effect in gearings or motors is also obtained with such mixtures.

Such mixtures can also be fractions of vegetable oils in the form of pumpable residues which are separated as minor components during the winterization of oils. At a temperature of 20° C. these contain both liquid and also solid components which show a surprisingly good lubricating effect. Further embodiment can be mixtures of these winterizing residues with fats or oils which are optionally also subjected to a partial esterification.

Even if the mixture according to the invention has a good resistance and stability as a result of a preferably high fraction of saturated fatty acids without further components or additives, it is nevertheless advantageous to add anti-oxidative substances to further increase the oxidation stability. Vegetable ingredients which are also contained in natural fats and are also soluble there, are advantageously used for this purpose. These can be carotenes, tocopherols, tocotrienols and other oil-soluble substances having an anti-oxidative effect. Contents between 0.1 and 10 mass % of anti-oxidative vegetable substances should be used for the technical application depending on the fraction of unsaturated fatty acids.

It is surprisingly shown that the lubricant has particularly advantageous properties when it has small fractions of inorganic particles (<1.5 μm). These are used as nuclei in fat crystallization and accelerate the formation of the solid phase.

Exemplary Embodiments

The composition and the application of the proposed lubricant is presented hereinafter with reference to two examples.

EXAMPLE 1

57 mass % of non-refined palm oil, 22 mass % of fatty acid ethyl ester of palm oil, 16 mass % of palm diglyceride and 5 mass % of palm monoglyceride are mixed at a temperature of 50° C. The resulting mixture has a solid fraction of >40 vol. % after cooling to a temperature of 20° C.

In a gear short test according to DIN ISO 14635-1 a scuffing load stage of 7 is achieved with the non-additivated lubricant. The lubricating properties of the palm-oil based medium are therefore comparable with weakly additivated lubricants based on mineral oil.

EXAMPLE 2

24 mass % of non-refined rape-seed oil, 42 mass % of fatty acid ethyl ester of rape-seed oil, 22 mass % of rape-seed diglyceride and 12 mass % of rape-seed monoglycerides are present in a mixture. In a Brugger test device (DIN 51347) a load-bearing capacity in the mixed friction range of 20.7 $N/mm^2$ is achieved with the non-additivated lubricant.

The invention claimed is:

1. Lubricating mixture, in particular for use in gearings and motors, which contains at least a mass fraction of ≥50% of glycerides of natural origin and a fraction of fatty acid alkyl esters having 1 to 4 C atoms in the alkyl group, wherein the glycerides are at least partly of at least one of monoglyderides and diglycerides, which form a mass fraction of ≥10% in the mixture, and wherein, over a temperature range of from >10° C. to at least 15° C., the mixture has a liquid phase with a solid fraction of ≥1 vol. %, which is formed from a fraction of at least one of glycerides and fatty acid alkyl esters.

2. The lubricating mixture according to claim 1, characterized in that the mixture has the liquid phase with the solid fraction of ≥1 vol. % over the temperature range of from >10° C. to at least 20° C.

3. The lubricating mixture according to claim 1, characterized in that, over the temperature range of from >10° C. to at least 15° C., the mixture has a liquid phase with a solid fraction of ≥50 vol. %.

4. The lubricating mixture according to claim 1, characterized in that, over the temperature range from >10° C. to at least 15° C., the volume fraction of liquid is ≥40 vol. %.

5. The lubricating mixture according to claim 1, characterized in that, over the temperature range from >10° C. to at least 15° C., the volume fraction of liquid is ≥80 vol. %.

6. The lubricating mixture according to claim 1, characterized in that the solid fraction is formed by solid particles which have an extension in the range between 4 μm and 5 mm.

7. The lubricating mixture according to claim 1, characterized in that the mixture contains a mass fraction of >30% of triglycerides.

8. The lubricating mixture according to claim 1, characterized in that the mixture contains a mass fraction of >10% of diglycerides and a mass fraction of >5% of monoglycerides.

9. The lubricating mixture according to claim 7, characterized in that the mass fraction of triglycerides is >40%.

10. The lubricating mixture according to claim 8, characterized in that the mass fraction of diglycerides is >15%.

11. The lubricating mixture according to claim 1, characterized in that the mixture contains a mass fraction of >10% of fatty acid alkyl esters.

12. The lubricating mixture according to claim 1, characterized in that the mixture contains a mass fraction between 0.1% and 4% of unbound mono- or polyvalent alcohol.

13. The lubricating mixture according to claim 1, characterized in that in addition to the solid fraction of at least one of glycerides and fatty acid alkyl esters, the mixture additionally comprises solid particles of at least one of other organic and inorganic substances which are still solid at a temperature of at least 90° C.

14. The lubricating mixture according to claim 13, characterized in that the solid particles of the at least one of other organic and inorganic substances are contained in the mixture in a mass fraction between 0.1% and 3%.

15. The lubricating mixture according to claim 13, characterized in that the solid particles of the at least one of other organic and inorganic substances have an extension in the range between 0.1 μm and 1.5 μm.

16. The lubricating mixture according to claim 1, characterized in that the glycerides in the solid fraction have an at least a factor of 1.5 higher fraction of monoglycerides than the glycerides in the liquid phase.

17. The lubricating mixture according to claim 1, characterized in that at least a portion of the glycerides is obtained from vegetable fats which contain a mass fraction of at least 30% of saturated fatty acids and are solid at a temperature of 20° C.

18. The lubricating mixture according to claim 17, characterized in that at least a portion of the glycerides is obtained from at least one of palm oil and coconut oil.

19. The lubricating mixture according to claim 17, characterized in that a portion of the glycerides is obtained from vegetable oils which are liquid at a temperature of 20° C.

20. A method according to claim 1 comprising:

utilizing the lubricating mixture as a lubricant.

21. The method according to claim 20 comprising:

utilizing the lubricating mixture as lubricant for gearings or motors.

22. The lubricating mixture according to claim 2, characterized in that, over the temperature range of from >10° C. to at least 20° C., the mixture has a liquid phase with a solid fraction of ≥50 vol. %.

23. The lubricating mixture according to claim 2, characterized in that, over the temperature range of from >10° C. to at least 20° C., the liquid phase comprises a fraction of ≥40 vol. % of the mixture.

24. The lubricating mixture according to claim 2, characterized in that, over the temperature range of from >10° C. to at least 20° C., the liquid phase comprises a fraction of ≥80 vol. % of the mixture.

25. The lubricating mixture according to claim 9, characterized in that the mass fraction of triglycerides is >50%.

26. The lubricating mixture according to claim 11, characterized in that the mixture contains a mass fraction of >15% of fatty acid alkyl esters.

* * * * *